US010619901B2

(12) United States Patent
Mast et al.

(10) Patent No.: US 10,619,901 B2
(45) Date of Patent: Apr. 14, 2020

(54) HEAT EXCHANGER WITH REFRIGERANT STORAGE VOLUME

(71) Applicant: TRANE INTERNATIONAL INC., Davidson, NC (US)

(72) Inventors: Jean Charles Mast, Benney (FR); Jean-Michel Genay, Laneuvelotte (FR)

(73) Assignee: TRANE INTERNATIONAL INC., Davidson, NC (US)

( * ) Notice: Subject to any disclaimer, the term of this patent is extended or adjusted under 35 U.S.C. 154(b) by 61 days.

(21) Appl. No.: 15/740,956

(22) PCT Filed: Jun. 29, 2015

(86) PCT No.: PCT/IB2015/001912
§ 371 (c)(1),
(2) Date: Dec. 29, 2017

(87) PCT Pub. No.: WO2017/001886
PCT Pub. Date: Jan. 5, 2017

(65) Prior Publication Data
US 2018/0195782 A1 Jul. 12, 2018

(51) Int. Cl.
*F25B 45/00* (2006.01)
*F25B 39/00* (2006.01)
(Continued)

(52) U.S. Cl.
CPC ..... *F25B 45/00* (2013.01); *F25B 39/00* (2013.01); *F25B 49/02* (2013.01);
(Continued)

(58) Field of Classification Search
CPC ..... F28B 1/00; F25B 45/00; F25B 2400/19; F25B 2400/16; F28D 1/05391
See application file for complete search history.

(56) References Cited

U.S. PATENT DOCUMENTS 3,392,542 A 7/1968 Nussbaum
3,766,744 A 10/1973 Morris et al.
(Continued)

FOREIGN PATENT DOCUMENTS

FR 2571127 A3 4/1986
WO 2008/045086 4/2008
WO 2008/136916 11/2008

OTHER PUBLICATIONS

International Search Report and Written Opinion, International Patent Application No. PCT/IB2015/001912, dated Feb. 22, 2016 (9 pages).

*Primary Examiner* — Ana M Vazquez
(74) *Attorney, Agent, or Firm* — Hamre, Schumann, Mueller & Larson, P.C.

(57) ABSTRACT

A heat exchanger, such as for example, a condenser coil constructed as a fin and microchannel tube is fluidly connected with a volume constructed and configured to store refrigerant in certain operations, such as for example during a pump down operation. The volume is fluidly connected to a fluid port of the heat exchanger, where the fluid port is an inlet (in the cooling mode) to the heat exchanger, such as the high side condensing section of the heat exchanger. The volume receives refrigerant exiting the heat exchanger from the fluid port in a mode other than a cooling mode, e.g., a pump down operation.

16 Claims, 7 Drawing Sheets

(51) Int. Cl.

| | |
|---|---|
| ***F25B 49/02*** | (2006.01) |
| ***F28F 1/02*** | (2006.01) |
| ***F28F 1/12*** | (2006.01) |
| ***F28D 1/053*** | (2006.01) |
| *F28D 21/00* | (2006.01) |
| *F25B 13/00* | (2006.01) |
| *F28B 1/00* | (2006.01) |

(52) U.S. Cl.

CPC ..... *F28D 1/05391* (2013.01); *F28F 1/022* (2013.01); *F28F 1/128* (2013.01); *F25B 13/00* (2013.01); *F25B 2400/16* (2013.01); *F25B 2400/19* (2013.01); *F25B 2600/2507* (2013.01); *F25B 2600/2523* (2013.01); *F28B 1/00* (2013.01); *F28D 2021/0063* (2013.01); *F28F 2260/02* (2013.01)

(56) References Cited

U.S. PATENT DOCUMENTS

| | | | | |
|---|---|---|---|---|
| 3,939,668 | A | 2/1976 | Morris | |
| 4,328,682 | A | 5/1982 | Vana | |
| 4,438,635 | A | 3/1984 | McCoy, Jr. | |
| 4,457,138 | A | 7/1984 | Bowman | |
| 4,537,660 | A | 8/1985 | McCord et al. | |
| 4,554,795 | A | 11/1985 | Ibrahim | |
| 4,566,288 | A | 1/1986 | O'Neal | |
| 4,621,505 | A | 11/1986 | Ares et al. | |
| 4,735,059 | A | 4/1988 | O'Neal | |
| 4,862,702 | A | 9/1989 | O'Neal | |
| 5,031,690 | A | 7/1991 | Anderson et al. | |
| 5,070,705 | A | 12/1991 | Goodson et al. | |
| 5,212,959 | A | 5/1993 | Galbreath, Sr. | |
| 6,029,472 | A | 2/2000 | Galbreath et al. | |
| 6,422,035 | B1 | 7/2002 | Phillippe | |
| 6,427,480 | B1 | 8/2002 | Ito et al. | |
| 6,698,236 | B2 | 3/2004 | Yamasaki et al. | |
| 6,981,390 | B2 | 1/2006 | Yamada et al. | |
| 7,117,688 | B2 | 10/2006 | Matsuoka et al. | |
| 7,886,549 | B2 | 2/2011 | Kawakatsu et al. | |
| 8,230,694 | B2 | 7/2012 | Scarcella et al. | |
| 9,410,709 | B2 | 8/2016 | Kopko et al. | |
| 2010/0011804 | A1* | 1/2010 | Taras | F25B 39/00 62/498 |
| 2010/0162739 | A1* | 7/2010 | Kopko | F24F 1/16 62/115 |
| 2011/0005243 | A1 | 1/2011 | Macri | |
| 2011/0030934 | A1 | 2/2011 | Munoz et al. | |
| 2011/0126559 | A1 | 6/2011 | Kopko et al. | |
| 2012/0067068 | A1* | 3/2012 | Munns | F25B 13/00 62/81 |
| 2012/0167614 | A1 | 7/2012 | Jin | |
| 2012/0255318 | A1 | 10/2012 | Kido et al. | |
| 2012/0272673 | A1 | 11/2012 | Yokohara et al. | |
| 2014/0053587 | A1 | 2/2014 | Arii | |
| 2014/0144166 | A1 | 5/2014 | Conjeevaram et al. | |
| 2014/0318165 | A1 | 10/2014 | Kanazawa et al. | |
| 2015/0052925 | A1 | 2/2015 | Hata et al. | |

* cited by examiner

HEAT EXCHANGER WITH REFRIGERANT STORAGE VOLUME

FIELD

The disclosure herein relates generally to a heat exchanger, such as for example, a condenser coil constructed fins and microchannel tubes. The heat exchanger is fluidly connected with a volume constructed and configured to store refrigerant in certain operations, such as for example during a pump down operation.

BACKGROUND

In a cooling system, such as for example a fluid chiller, e.g., water chiller, it may be desired to remove enough refrigerant out from the evaporator and out of contact with water tubes in the evaporator. This can avoid water tubes in the evaporator from freezing due to refrigerant migration from the evaporator to the condenser, such as at low ambient conditions. A pump down operation may be used to remove refrigerant out from the evaporator to address this problem, and the refrigerant is then stored for a period of time.

SUMMARY

In a cooling system that uses microchannel tubes in its heat exchanger construction, such as for example in a condenser coil, the internal volume of such a heat exchanger may be relatively small. In the removal of refrigerant from the evaporator, such as for example in the pump down operation, such a heat exchanger with microchannel tubes may not provide sufficient storage for the refrigerant.

The disclosure herein relates generally to a heat exchanger, such as for example, a condenser coil constructed with fins and microchannel tubes. The heat exchanger is fluidly connected with a volume constructed and configured to store refrigerant in certain operations, such as for example during a pump down operation.

In an embodiment, a heat exchanger includes a microchannel coil, the microchannel coil includes flattened tubes with ends connected to headers, and includes fins between the flattened tubes. The flattened tubes include multiple channels fluidly connected with the headers to pass a working fluid, such as for example a refrigerant mixture, through the multiple channels of the flattened tubes and through the headers. The flattened tubes and fins are constructed and arranged to pass a heat exchange fluid, such as for example air, through the microchannel coil externally of the flattened tubes and fins so as to have a heat exchange relationship with the working fluid. The microchannel coil includes a first fluid port fluidly connected with one of the headers, and a second fluid port fluidly connected with one of the headers. In an embodiment, the first fluid port is arranged relatively at a higher location than the second fluid port. In a cooling mode, the first fluid port receives the working fluid, and the second fluid port exits the working fluid after the working fluid has passed through the flattened tubes and the headers. In a mode other than the cooling mode, such as for example in a mode to store refrigerant, which in some circumstances is a pump down mode, the second fluid port receives the working fluid, and the first fluid port exits the working fluid after the working fluid has passed through the flattened tubes and headers. The heat exchanger further includes a volume fluidly connected with the first fluid port. In the cooling mode, the volume is constructed and arranged to pass the working fluid through the volume and to the first fluid port into the header fluidly connected with the first fluid port. In the mode other than the cooling mode, the volume is constructed and arranged to receive the working fluid from the first fluid port and to store the working fluid.

In an embodiment, the heat exchanger further includes a flow control device fluidly connected with the volume. In the cooling mode, the flow control device is open to pass the working fluid through the volume and into the first fluid port and into the microchannel coil. In the mode other than the cooling mode, the volume stores the working fluid received from the first fluid port, where the flow control device may be closed.

In an embodiment, the first fluid port is fluidly connected to a condensing section of the microchannel coil. In an embodiment, the first fluid port is connected to an inlet of the condensing section.

In an embodiment, the second fluid port is fluidly connected to a sub-cooling section of the microchannel coil. In an embodiment, the second fluid port is connected to an outlet of the microchannel coil, such as for example an outlet of the liquid and/or sub-cooled liquid section of the microchannel coil.

In an embodiment, the volume is constructed to receive a substantial amount of the working fluid charge designed for a cooling system in which the heat exchanger is implemented.

In an embodiment, a fan is assembled with the heat exchanger to draw the heat exchange fluid over the microchannel coil.

In an embodiment, the volume is disposed within a perimeter defined by an arrangement of the microchannel coil, the fan, and another coil, which in some circumstances is also a microchannel coil.

In an embodiment, a cooling system, which in some instances is a fluid chiller such as for example a water chiller where water is the working fluid, includes a heat exchanger as described above. The cooling system includes a compressor fluidly connected with the heat exchanger, an expansion device fluidly connected with the heat exchanger, and another heat exchanger fluidly connected with the expansion device. The heat exchanger is a condenser and the other heat exchanger is an evaporator. In an embodiment, the fluid chiller is an air-cooled chiller, for example where the heat exchanger is an air-cooled condenser.

In an embodiment, a method of operating a cooling mode of a cooling system includes compressing a working fluid, directing the working fluid to a heat exchanger as described above, directing the working fluid from the heat exchanger to an expansion device, and directing the working fluid from the expansion device to another heat exchanger, and returning the working fluid to the compressor. In an embodiment, the heat exchanger is a condenser, the another heat exchanger is an evaporator. The step of directing the working fluid from the compressor to the heat exchanger includes directing the working fluid through a volume prior to the working fluid flowing into the first fluid port. In an embodiment, the step of directing the working fluid from the compressor to the heat exchanger includes directing the working fluid from the compressor to flow control device and, from the flow control device, to the heat exchanger.

In an embodiment, a method of storing a working fluid, such as a refrigerant mixture, in a cooling system includes directing the working fluid into a heat exchanger as described above by directing the working fluid through the second fluid port. The method further includes directing the working fluid out of the microchannel coil and out of the first fluid port, directing the working fluid into a volume, and storing the working fluid in the volume.

In an embodiment, a method of retrofitting an existing cooling system includes fluidly connecting a volume to a fluid line fluidly connecting a compressor to a microchannel heat exchanger. The method further includes fluidly connecting the volume to a fluid port, which is fluidly connected to the microchannel heat exchanger, and installing a valve on the fluid line.

DRAWINGS

These and other features, aspects, and advantages of the heat exchanger, cooling system, and methods of use thereof will become better understood when the following detailed description is read with reference to the accompanying drawing, wherein.

While the above figures set forth embodiments of the heat exchanger, cooling system, and methods of use thereof, other embodiments are also contemplated, as noted in the following descriptions. In all cases, this disclosure presents illustrated embodiments of the heat exchanger, cooling system, and methods of use thereof by way of representation but not limitation. Numerous other modifications and embodiments can be devised by those skilled in the art which fall within the scope and spirit of the principles of the heat exchanger, cooling system, and methods of use thereof described herein.

DETAILED DESCRIPTION

The disclosure herein relates generally to a heat exchanger in a cooling system, such as for example, a condenser coil constructed as a fin and microchannel tube. The heat exchanger is fluidly connected with a volume constructed and configured to store refrigerant in certain operations, such as for example during a pump down operation.

Figure 1:
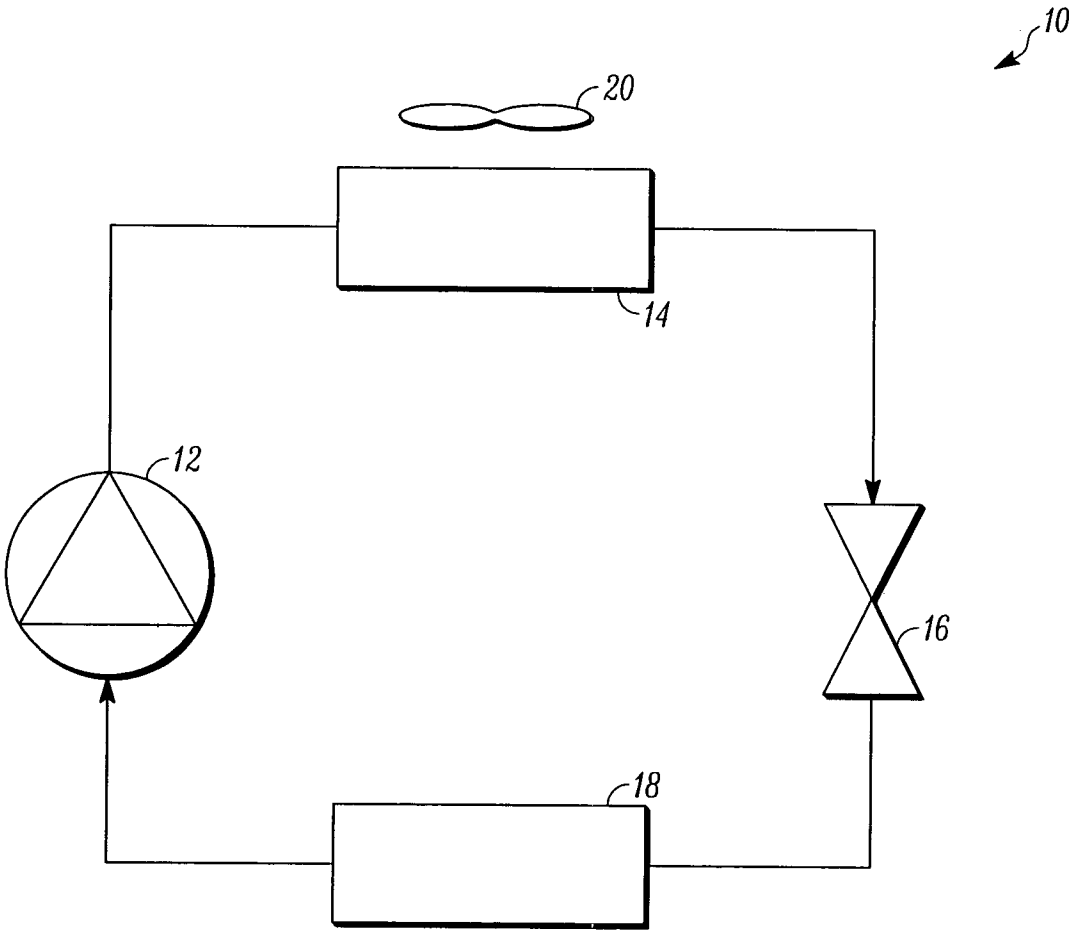
FIG. 1 is a schematic view of a cooling system, which includes a compressor, heat exchanger as a condenser, expansion device, and a heat exchanger as an evaporator according to an embodiment.

FIG. 1 is a schematic view of a cooling system 10, which includes a compressor 12, heat exchanger 14 as a condenser, expansion device 16, and a heat exchanger 18 as an evaporator according to an embodiment. In an embodiment, the cooling system 10 cools a working fluid. In an embodiment, the cooling system 10 is a fluid chiller. One example of a fluid chiller is a water chiller, where water is the working fluid. In an embodiment, the fluid chiller is an air-cooled fluid chiller. In an embodiment, the condenser of the cooling system 10 is an air-cooled condenser. It will be appreciated that the working fluid may be fluids other than water and/or blends that may or may not include water.

The cooling system 10 directs a working fluid, which in some cases is a refrigerant mixture, through the circuit of FIG. 1, and it will be appreciated that the working fluid in some cases is a single component, e.g., a single refrigerant. The refrigerant mixture can include various components including one or more refrigerants, as well as one or more lubricants, additives, and other fluids. The refrigerant mixture and any of its components can be present in various phases such as for example vapor and/or liquid, depending on where in the circuit of the cooling system 10 the mixture is, such as for example during a cooling operation.

The compressor 12 compresses the working fluid, and directs the working fluid to the condenser 14. The condenser 14 condenses the working fluid from a vapor to a liquid and directs the working fluid to the expansion device 16. The condenser 14 in some cases can employ a fan 20 which draws a heat exchange fluid, such as for example air, across the condenser 14 to condense the working fluid. The condenser 14 may include one or more heat exchanger coils which pass the working fluid through the condenser 14. The expansion device 16 expands the working fluid to further cool the working fluid, where the working fluid can become a mixed vapor liquid phase fluid. The working fluid is directed to the evaporator 18, where the working fluid is evaporated into a vapor. The working fluid may then return to the compressor 12 and be recirculated through the circuit.

One example of a heat exchanger coil may be a microchannel heat exchanger coil (microchannel coil). A microchannel coil in some instances has flattened tubes that extend from one or more headers. A microchannel coil may have one or more rows of flattened tubes, be folded on itself, and may use the same header or have different headers connected to the ends of the flattened tubes. A microchannel coil has multiple channels within each of the flattened tubes and fins between the flattened tubes.

Figure 2:
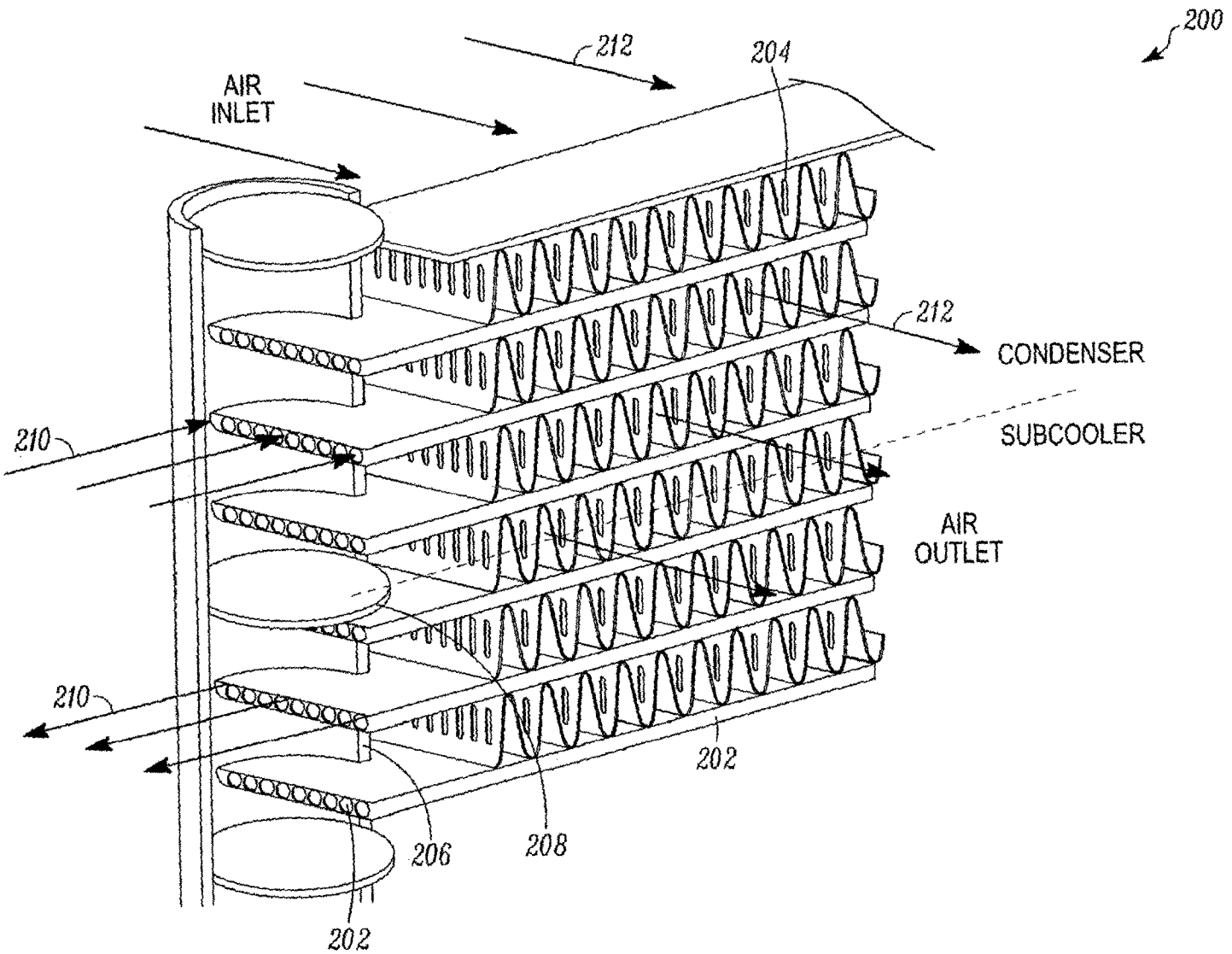
FIG. 2 is a partial perspective and internal view of a microchannel tube and fin coil according to an embodiment, which may be implemented in a heat exchanger, such as for example the condenser of the cooling system of FIG. 1 according to an embodiment.

FIG. 2 is a partial perspective and internal view of an embodiment of a microchannel tube and fin coil 200 (microchannel coil 200) according to an embodiment. The microchannel coil 200 may be implemented in a heat exchanger, such as for example the condenser 14 of the cooling system 10 of FIG. 1 according to an embodiment.

As shown in FIG. 2, the microchannel coil 200 includes flattened tubes 202 with openings, with fins 204 between the flattened tubes 202. The flattened tubes 202 are fluidly connected with a header 206. In the embodiment shown in FIG. 2, the header 206 in some instances may include a partition 208, which can define sections of the microchannel coil 200. In an embodiment, the partition 208 may define a condensing section of the microchannel coil 200, such as for example above the partition 208 (and above the dashed line), and may define a liquid and/or sub-cooling section, such as for example below the partition 208 (and below the dashed line). The refrigerant mixture flow through the microchannel coil 200 is illustrated by the direction arrows referenced by 210. In an embodiment, the refrigerant mixture may flow down through the openings in flattened tubes 202 through one portion of the microchannel coil 200, e.g., the condensing section, and then return through another portion of the microchannel coil 200, e.g., the sub-cooling section. The partition 208 separates the flows at the header 206. It will be appreciated that the microchannel coil 200 in some instances may have another header (not shown) at the opposite end of the flattened tubes 202.

A heat exchange fluid, such as for example air, e.g., ambient air, may be drawn through and across the microchannel coil 200, as indicated by the direction arrows 212. As shown, relatively cooler air may pass through the microchannel coil 200, cool the working fluid flowing through the flattened tubes 202 and header(s) 206, and exit the microchannel coil 200 as relatively warmer air. The air passing through the coil passes externally of the flattened tubes 202 and fins 204, and is in a heat exchange relationship with the working fluid. In an embodiment, it will be appreciated that the overall structure of the microchannel coil may have tubes that extend straight from one end to another end (e.g. from one header to another header) or may have tubes that are folded, bent, or rolled, and may have for example a single header or more than one header on the same side or end.

Figure 3:
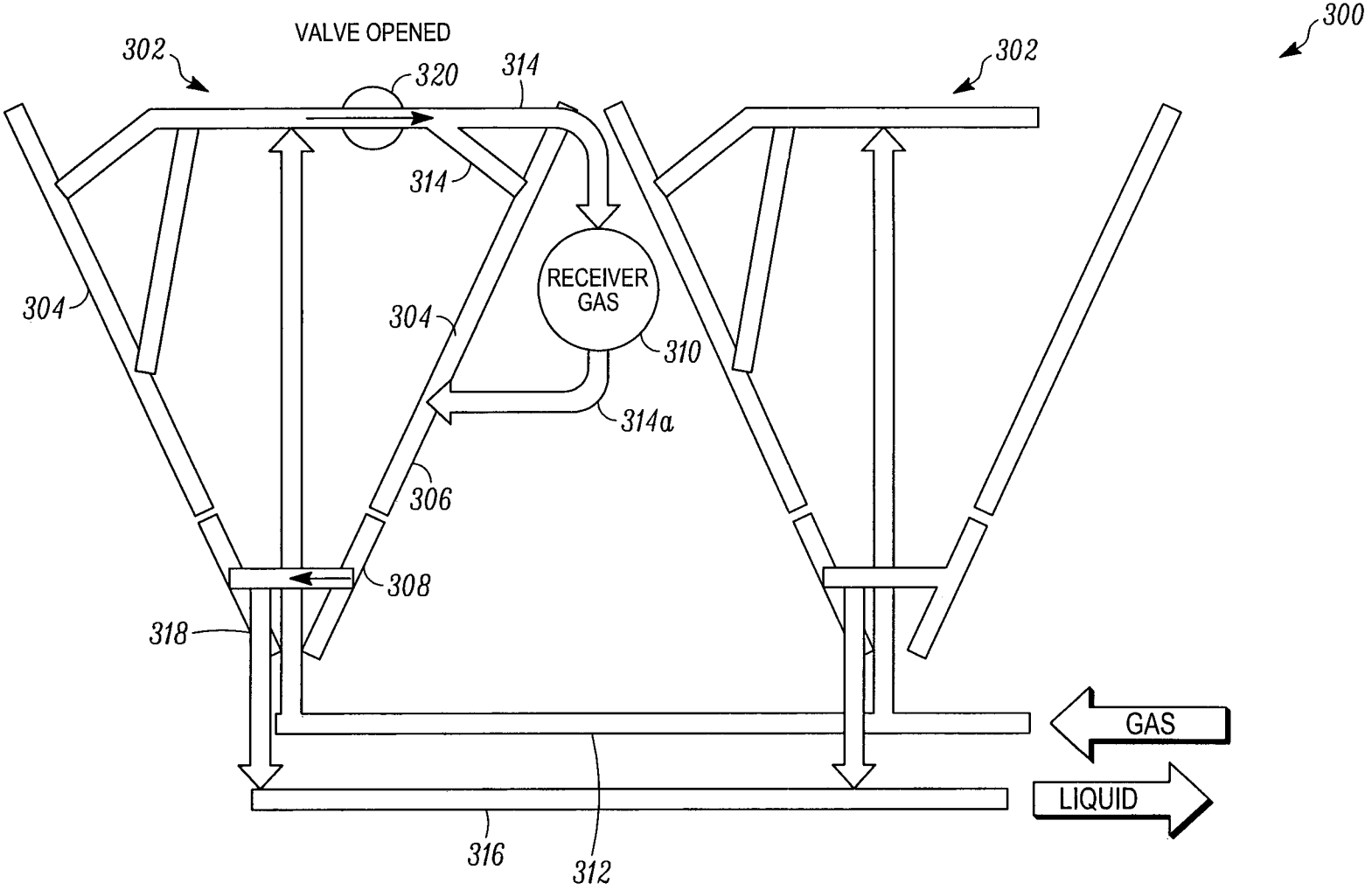
FIG. 3 is a side schematic view a condenser which may be implemented in the cooling system of FIG. 1, and shown operating in a cooling mode.
Figure 4:
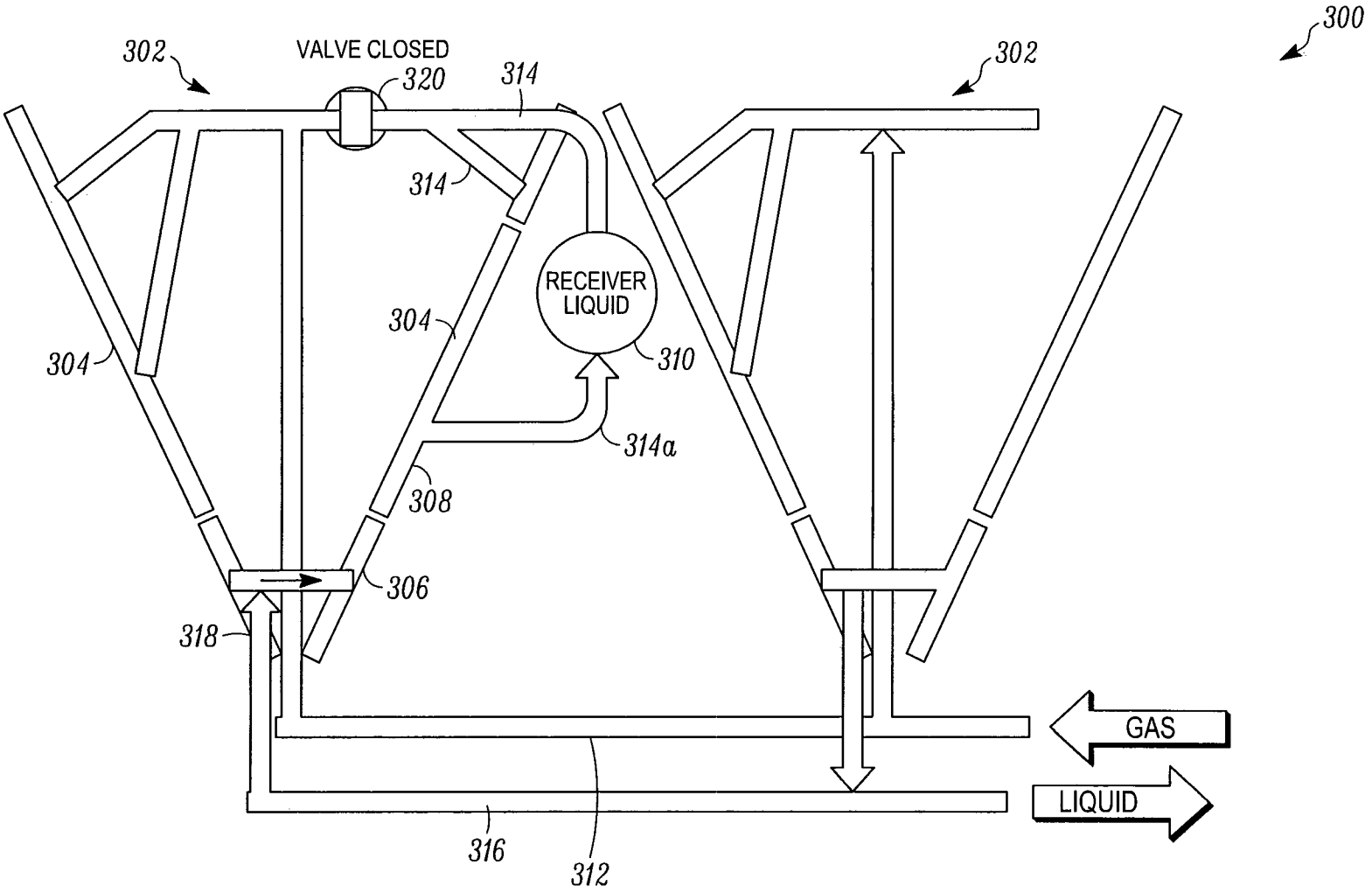
FIG. 4 is a side schematic view the condenser of FIG. 3 and shown operating for example in a mode to store refrigerant in a volume of the condenser.

FIGS. 3 and 4 show side schematic views a condenser 300 which may be implemented in the cooling system 10 of FIG. 1. FIG. 3 shows the condenser 300 operating in a cooling mode.

The condenser 300 includes one or more condensing units 302, which includes one or more heat exchanger coils 304 (coils 304) and can have one or more fans (not shown in FIGS. 3 and 4). FIG. 3 shows two condensing units 302, but it will be appreciated that one or more than two condensing units 302 may be implemented in any given condenser 300. As shown, the configuration, orientation of the condensing units 302 resembles a V shape, where the coils 304 are slanted or angle outward from the bottom. It will be appreciated that the particular configuration and orientation shown is not meant to be limiting as other configurations and orientations may be employed, such as for example an A shape, a W shape, or other shape or geometry.

In an embodiment, one or both of the coils 304 of a condensing unit 302 are microchannel coils. In an embodiment, the coils 304 may be microchannel coils similar to the microchannel 200 coil illustrated in FIG. 2. In an embodiment, the coils 304 include a condensing section 306 and a sub-cooling section 308.

The condenser 300 by way of inlet(s) 314 and one or more fluid ports 314*a* is fluidly connected with a line 312 to receive the working fluid, and by way of one or more fluid ports 318, is fluidly connected with a line 316 to exit the working fluid after having passed through the microchannel tubes and headers of the coils 304. In an embodiment, the fluid port 314*a* is arranged relatively at a higher location than the fluid port 318. In an embodiment, the line 312 is a discharge line from a compressor, and in an embodiment, the line 316 is a line to an evaporator. In an embodiment, any of lines 312, 316 in some circumstances are in fluid communication with other components of the fluid circuit. For example, the line 316 in some instances is fluidly connected with another component such as for example an expansion device, e.g. 16 in FIG. 1, which is located between the condenser and evaporator. In another example, the line 312 is fluidly connected with a component such as a lubricant separator, which is located between the compressor and the condenser.

In an embodiment, the condenser 300 includes one or more inlets 314 to feed the working fluid from the line 312 into the coils 304 by way of one or more fluid ports 314*a*. It will be appreciated that one or more fluid ports 314*a* may be employed to support the inlet(s) present. In the embodiment shown, two inlets 314 are shown entering the coil 304. It will be appreciated that one inlet or more than two inlets may be employed. It will also be appreciated that more than one fluid port 318 may be employed.

In an embodiment, a volume 310 is between the line 312, and along one of the inlets 314. Fluid port 314*a* is fluidly connected with the volume 310 and provides access into the coil 304, such as for example into a header of microchannel coil 304. In an embodiment, the fluid port 314*a* is fluidly connected with the condensing section 306 on the inlet side entering the coil 304. It will be appreciated that the other inlet 314, as well as other inlets which may be implemented with the coil 304, may also be fluidly connected with the volume 310 and include a similar fluid port as fluid port 314*a* to provide access into the coil 304 via the volume 310.

In an embodiment, the volume 310 is a receiver or other suitably constructed container, vessel, or the like, which is suitable to hold, contain, or otherwise store a fluid such as for example a refrigerant mixture therein. It will also be appreciated that the volume may not be a separately dedicated volume, for example where the volume in some circumstances is an oversized discharge line (e.g. a "gas" line between the compressor and condenser), so the diameter and/or length of the discharge line is relatively larger than other fluid lines and can hold a substantial charge of refrigerant relative to normally constructed fluid lines in the system. It will be appreciated that the volume 310 includes openings for fluid flow to enter and exit the volume 310. It will be appreciated that the volume 310 is designed to meet regulatory standards, such as for example being a Pressure Equipment Directive (PED) compliant vessel according, for example, to European standards, and/or being an American Society of Mechanical Engineers ASME compliant vessel according to U.S. standards. It will also be appreciated that, depending on the compressor type, one or more lubricant (e.g. oil) separators may be between the compressor and condenser (see e.g. 526 in FIG. 6). In some circumstances, the oil separator(s) may store some of the refrigerant charge as refrigerant vapor.

In an embodiment, such as shown in FIGS. 3 and 4, the volume 310 is disposed in the fluid circuit before the working fluid enters the microchannel heat exchanger, such as during a cooling mode. For example, the volume 310 is upstream of fluid port 314*a*.

In an embodiment, the volume 310 is disposed in the fluid circuit in lines that pass vapor during for example the cooling mode. In the embodiment shown, the volume is along inlet 314 which is fluidly connected with the line 312, which can be, e.g., the compressor discharge line.

In an embodiment, the volume 310 is not disposed in the fluid circuit in lines that would be characterized as liquid lines of the cooling system. In an embodiment, the volume is not connected between vapor lines and liquid lines, but only within vapor lines.

As shown, the volume 310 is disposed on the outside of the arrangement of the coils 304. It will be appreciated that the volume 310 may be located in various locations of the condenser 300. For example, the volume 310 can be disposed on any of the condensing units 302 of the cooling system, may be inside or outside the perimeter defined by the coils and fan(s) (e.g. inside or outside V shaped coil), and with respect to any of the fan(s), and does not necessarily have to be located with respect to the last or end condensing unit (e.g. does not have to be located with last condensing unit and fan or set of fans that may stop last, such as during a pump down operation).

In an embodiment, the condenser includes one or more flow control devices 320 located prior to the inlet(s) 314.

In an embodiment, the flow control device 320 is a valve which can be automatically and/or actively controlled by the controller of a unit (cooling system e.g., fluid chiller) or a system controller, which controls multiple units and/or devices (e.g. in a building). It will be appreciated that unit and system controllers are well known, for example to control a pump down operation and to control the normal operation (e.g. cooling mode) of the cooling system. It will be appreciated that the flow control device 320 can be any suitable valve whether controlled or manually operated. In some circumstances, the flow control device 320 is a manually operated valve, for example in a system which uses maintenance pump down and not operational pump down.

In an embodiment, the flow control device 320 is a solenoid valve which is controllable to an open and closed state. For example, in the activated state the solenoid valve is closed, and in the non-activated state the solenoid valve is open. It will be appreciated that the flow control device 320 can be automatically controlled, e.g., activated about a few seconds before cooling system shutdown. It will also be appreciated that the flow control device 320 can be deactivated to open to start up the cooling system with no issue, for example after the working fluid has been removed from the volume 310. In some examples, removing the working fluid from the volume 310 may take a certain amount of time, such as about a few minutes, depending on the size of the volume 310.

In an embodiment, the flow control device 320 is in the open state, but not during pump down. The flow control device 320 activates or closes when a pump down is to be initiated, which may be controlled to a set point based on an ambient temperature or system pressure or temperature. The flow control device 320 deactivates or opens when the compressor shuts down. In an embodiment, the flow control device 320 may be activated or closed just before or after starting a pump down cycle, and then deactivated or opened after compressor shutdown.

In an embodiment, in a cooling mode the compressor is on and the flow control device is open. In an embodiment, in a non-cooling mode such as during a pump down operation, the compressor may be on and the flow control device is closed. In an embodiment, in a non-cooling mode such as when the compressor is off or on standby, the flow control device may be open or closed.

In an embodiment, when the compressor is off, the volume may still store fluid even if the flow control device is open. The flow control device in some circumstances isolates the volume from the discharge side and the goal of a pump down is to empty the evaporator (refrigerant moved to the condenser and volume).

In an embodiment, the pump down cycle can include closing the expansion device, e.g. expansion valve, which is upstream of the evaporator. In some circumstances, the compressor is also unloaded. Unloading the compressor can help to avoid high pressure limits before filling of the condenser where the gas refrigerant has relatively less condenser area (e.g. in a microchannel coil) to condense the fluid so it may be desirable to reduce refrigerant flow to the condenser. Closing the expansion device and unloading of the compressor can be a simultaneous operation to help speed up the pump down process.

As shown in FIGS. 3 and 4, a microchannel heat exchanger used in the condenser 300 has multiple inlets, for example two inlets. In an embodiment, the flow control device 320 is disposed before the fluid line is separated into the two inlets 314. The volume 310 is disposed between the flow control device 320 and on one of the inlets 314, where the fluid port 314 provides access to the coil 304. It will be appreciated that both inlets 314 may direct the working fluid into the volume 310. In one embodiment, one of the inlets 314 extends lower than the other inlet, e.g. by way of the fluid port 314*a*, and the volume 310 is fluidly connected with the relatively lower inlet. The flow control device 320 in an operation of the cooling system, e.g.; in the cooling mode, is open. The volume 310 can receive relatively hot vapor from the compressor and pass the vapor to the microchannel coil 304 of the heat exchanger. The flow control device 320 in a non-cooling mode operation of the cooling system can be closed. For example, in a volume filling operation, such as a pump down operation, the volume 310 is filled by liquid refrigerant in a reverse flow from the evaporator into the microchannel coil 304, out of the microchannel coil and into the volume 310. For example, when the cooling system (e.g. chiller) is off, the flow control device (e.g. valve) is normally opened or not activated. In an embodiment, when the cooling system is off, the flow control device may also be closed or activated.

With specific reference to FIG. 3, the condensing unit 302 shows the flow control device 320 in the open state. Discharge vapor, e.g., from a compressor, flows from line 312, through the flow control device 320, into the inlet 314, and through the volume 310. Flowing through the volume 310 means that the working fluid flows into and out of the object volume 310, which can include flowing through a portion of the volume inside, which may be the entire volume or less than the entire volume. For example, the working fluid does not have to occupy at any time the entire volume within the volume when flowing "through" volume 310.

As shown, the volume 310 is located outside the V shaped coils, but it will be appreciated that the volume 310 can be located inside the V (see e.g., FIGS. 5-7, which are further described below.

With specific reference to FIG. 4, the condensing unit 302 shows the flow control device 320 in the closed state. In an embodiment, the flow control device 320 is in the closed state, for example during a non-cooling mode. In an embodiment, one example of a non-cooling mode is during a volume filling operation such as a pump down operation or when the cooling system is shut down. In the closed state, fluid flow is prevented from the line 312 to the coils 304 of the condensing unit 302, for example from the compressor. The pressure and temperature in the microchannel coil 304 on which the volume 310 is located, can become relatively lower. In some circumstances, the pressure and temperature of the coil 304 may be relatively lower than other coils of the cooling system. For example, the temperature and pressure can become slightly lower because gases are condensing to liquid, where liquid from the microchannel coil balances pressures. Temperature can becomes lower because as more superheated gas enters the microchannel, it is replaced by liquid or super-cooled liquid, which can be relatively more supercooled as it flows from a liquid line through the microchannel. In some circumstances, liquid from other coils flow in a reverse direction and fills the microchannel coil 304 and volume 310. In an embodiment, this can be toward the end of the condenser such as for example the last of the condensing units relative to the evaporator (e.g. or the condensing unit fluidly closer to the compressor). It will be appreciated that the condenser 300 may have more than one volume and flow control device of varying sizes to accommodate the needs of a given condenser of a cooling circuit taking into account cost, regulation, and manufacturing considerations such as available space.

It will be appreciated that the flow control device(s), e.g. 320, herein is closed in modes intended to fill the volume, e.g. 310, such as, for example, in a pump down operation. It will be appreciated that the flow control device(s) can be closed in other non-cooling modes, while it will also be appreciated that in certain non-cooling modes other than a pump down operation, the flow control device(s) may be opened or closed, such as, for example, when the compressor is off.

Some cooling system designs may employ an evaporator that is a flooded type of evaporator, which in some instances may be a shell and tube type of construction. In some instances, a flooded evaporator can have a relatively high ratio of refrigerant volume (e.g. shell side) to water volume (e.g. tube side). The relatively high ratio potentially makes the water inside the evaporator water tubes susceptible to freezing, such as for example if the refrigerant is allowed to migrate and the ambient temperature is below 30° F. (may be lower temperature if a freeze inhibitor is applied). It will be appreciated that such circumstances can apply to other types of evaporators, such as a falling film evaporator, where the ratio of refrigerant volume to water volume may not be as high, as long as there may be risk of pooling refrigerant at the bottom of the evaporator, which can affect some of the tubes of the evaporator. Refrigerant migration may occur in conditions where there is refrigerant in the evaporator, and the condenser is colder than the evaporator. Freezing may be a concern upon shutdown of the cooling system, such as in relatively cold conditions, for example when the condenser rapidly changes from a high to a low temperature. Refrigerant migration can also be an issue after long periods of off time when there is a rapid drop in ambient temperature.

To avoid evaporator water tubes from freezing due to refrigeration migration from the evaporator to the condenser at low ambient conditions, refrigerant is removed from the evaporator, such as for example to a level below the water tubes. Refrigerant is then stored in another volume of the condenser, e.g., a vessel, container, reservoir, receiver, holding structure, or the like. Such a process can be involved in what is called a pump down operation. It will be appreciated that the volume 310 herein may be sized, constructed, arranged, and/or otherwise configured to hold a substantial amount of the working fluid charge of the system. This amount can be the entire charge of the cooling system or any amount less than the entire charge that would be sufficient in various operations, such as in a pump down operation. It will be appreciated that the some of the charge may suitably be retained by the coils, in which case not all of the volume is employed or the size of the volume may be designed according to the capacity of the coil, e.g. microchannel coil.

A goal of the pump down operation is to empty an amount of refrigerant from the evaporator, e.g., to avoid evaporator water tubes freezing due to refrigerant migration from evaporator to condenser such as for example at low ambient conditions, or to remove enough of an amount of refrigerant from the evaporator to not have refrigerant in contact with the water tubes. It will be appreciated that pump down can also be done for maintenance or service, e.g., when there is a need and/or desire to open a low pressure side of the cooling circuit and remove refrigerant from the low pressure side. Generally, the amount of refrigerant to be removed from the evaporator can vary depending on the cooling system design. Generally, at least a sufficient amount of refrigerant is removed so as not to be susceptible to freezing or to a level of freezing which may be harmful and/or undesired. The volume 310 can be sized and located appropriately to meet the system design, and may include more than one volume (e.g. multiple 310*s*).

Cooling system designs with microchannel coils in some instances can present a challenge for storing refrigerant, as the volume available in a microchannel coil is relatively very low compared to the volume amount of refrigerant that may need to be stored.

The additional volume 310 for liquid storage, e.g., available for a pump down operation, and which does not affect normal operation, e.g., cooling mode of a water chiller is useful to supplement what volume condensing unit(s) may provide (e.g. the liquid lines, the coils, headers, etc.). In an embodiment, the volume 310 can be implemented as a refrigerant storage vessel in a condenser of a cooling system such as for example a chiller, where the refrigerant storage vessel is in fluid communication with the microchannel coil. The refrigerant storage vessel provides system volume for non-cooling mode operations, e.g., for pump down operations to store refrigerant.

Figure 5:
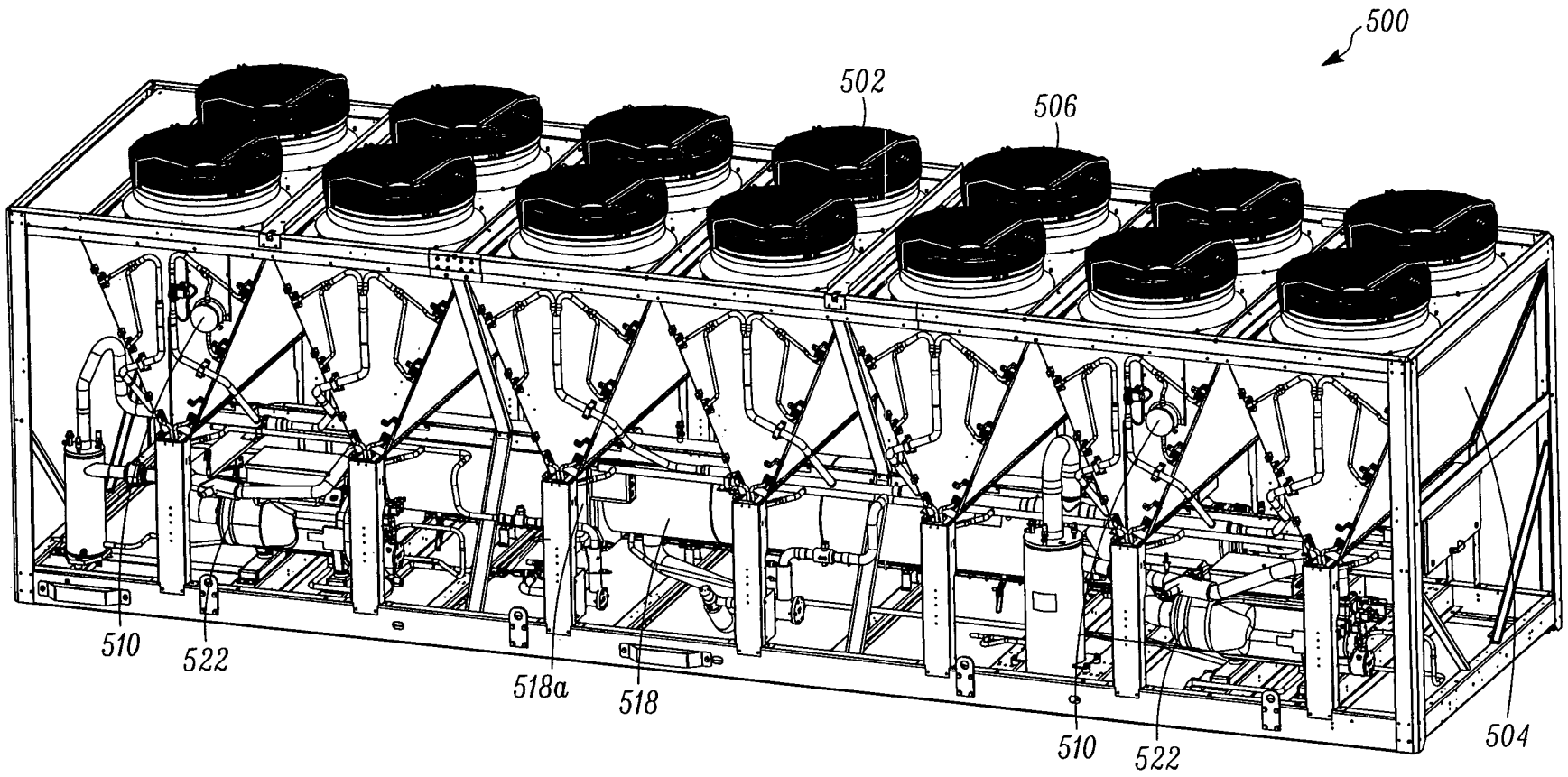
FIG. 5 is a perspective view of a condenser which may be implemented in the cooling system of FIG. 1 according to an embodiment.
Figure 6:
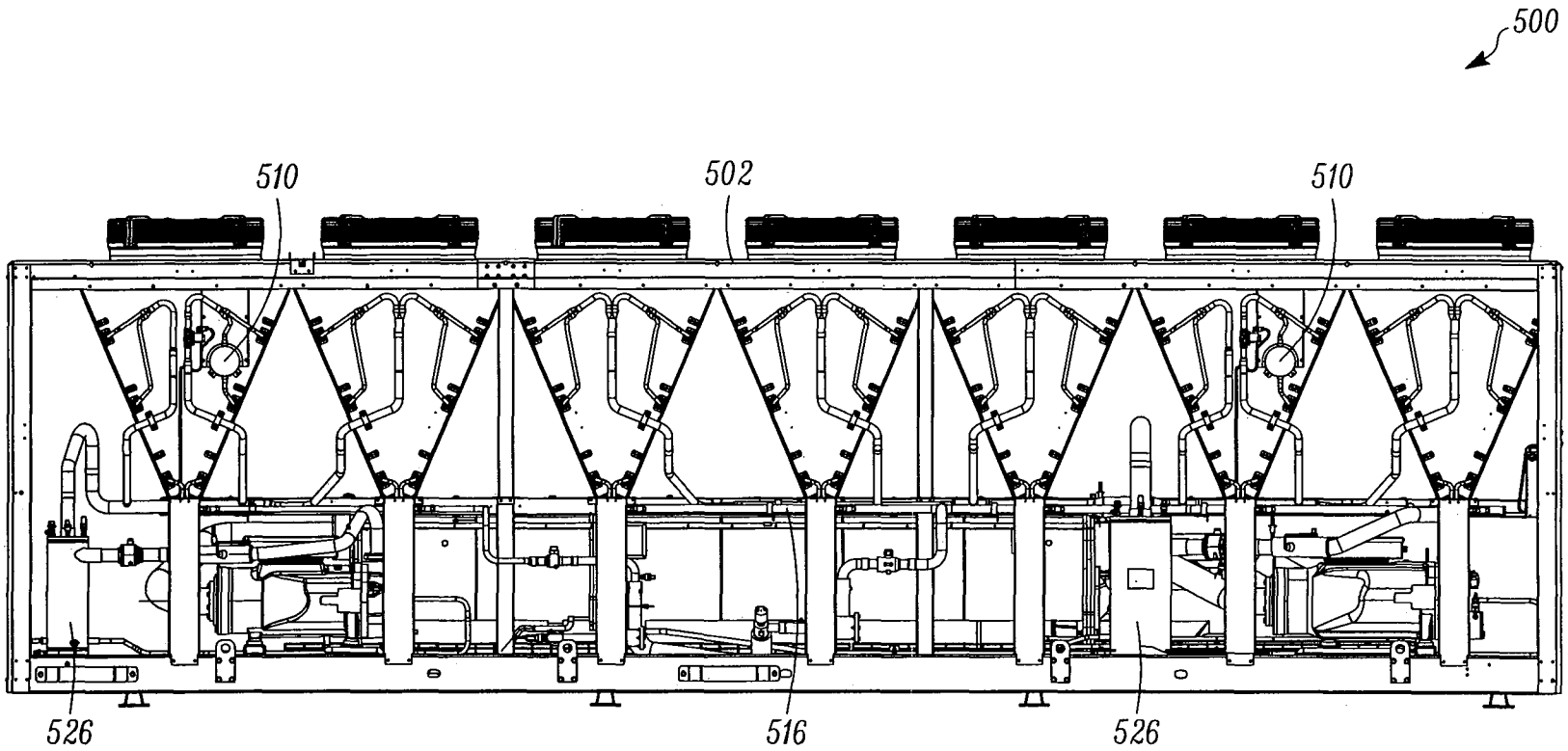
FIG. 6 is a side view of the condenser of FIG. 5.
Figure 7:
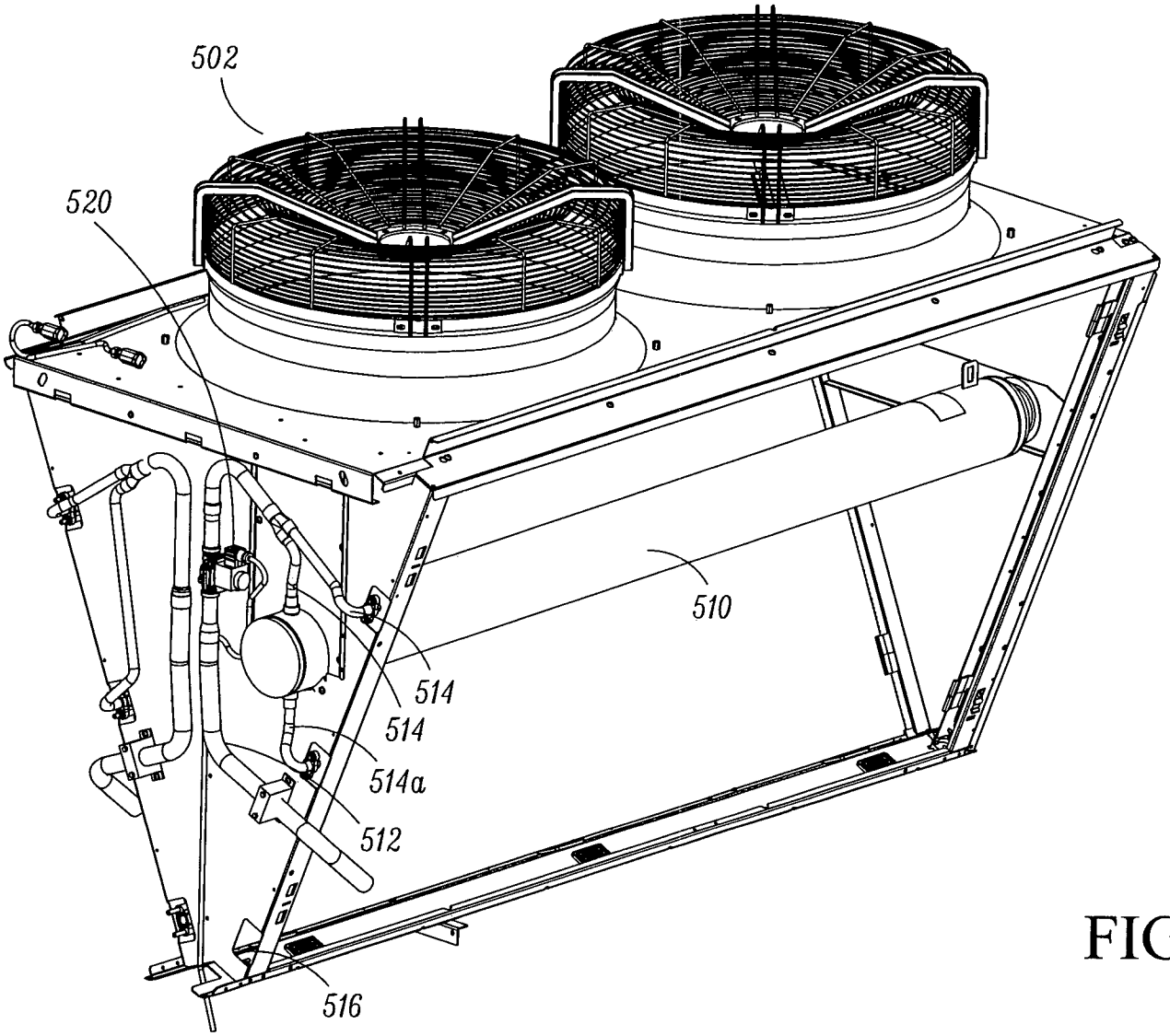
FIG. 7 is a perspective view of a portion of the condenser of FIG. 5.

FIGS. 5-7 show views of an embodiment of a condenser 500, which may be implemented in the cooling system of FIG. 1. FIG. 5 is a perspective view of the condenser 500. FIG. 6 is a side view of the condenser 500 of FIG. 5, and FIG. 7 is a perspective view of a portion of the condenser 500 of FIG. 5, such as for example one of the condensing units 502.

The condenser 500 includes condensing units 502. As shown, there are multiple condensing units, for example seven, as counted by the number of V shaped configurations of the condenser 500. The condenser 500 is shown as part of a cooling system which includes compressor 522 and evaporator 518, and fans 506. It will be appreciated that a cooling system, such as the cooling system shown in FIG. 1 or in FIGS. 5 and 6, may include more than one circuit. In an embodiment, the cooling system services two circuits, and has two sets of condensing units, each of which includes a volume 510 and its own compressor. In the embodiment shown, the sets of condensing units are divided into two groups, where the coils of one of the middle condensing units 502 can be split to serve each side (e.g. or circuit), for example the third condensing unit 502 from the left. In an embodiment, the left side compressor 522 includes two condensing units 502 (and four fans 506). In an embodiment, the right side compressor 522 includes five condensing units 502 (and ten fans 506). It will be appreciated that the circuit configuration and condenser unit apportionment can be modified as desired and/or necessary depending on the system design. In an embodiment, the evaporator 518 is a dual evaporator in a single evaporator shell, where in the example illustrated, one of the circuits is larger than the other. The separation of the evaporator 518 may be at location 518*a* of the evaporator 518 as shown in FIG. 5. Outlet or liquid line 516 is in fluid communication with the evaporator 518 from the condensing units 502.

As shown, the volume 510 is within the perimeter defined by the coil and fan arrangement. Two volumes 510 are shown, one to serve each circuit of the cooling system. It will be appreciated that the volumes 510 may be placed at various locations of the condenser and on any of the condensing units, taking into account various factors, such as for example production cost and convenience. In an embodiment, the fan(s) may be on or off during a pump down operation. In an embodiment, when the fan(s) are off, there is no forced air flow used to facilitate movement of the working fluid through the circuit. In an embodiment, when the fan(s) are on, forced air flow is used to facilitate movement of the working fluid through the system which under certain circumstances can make pump down operation run faster. In an embodiment, the volume can also be in another location without fan or "out of forced airflow"

location (for example volume is an oversized discharge line(s), which are not placed within the airflow path.

FIG. 7 shows in more detail components of one of the condensing units 502. The condensing unit 502 includes microchannel coils 504 (shown in FIG. 5) that are supported by the frame of the condensing unit. For ease of visibility of the volume 510, the coil is not shown in FIG. 7. Line 512 delivers the working fluid to the microchannel coil 504 by way of the inlets 514. The volume 510 is fluidly connected with one of the inlets 514, but it is appreciated that the other inlet 514 may also be fluidly connected with the volume 510. The lower of the inlets 514 is shown as fluidly connected to the volume 510, which accesses the coil 504 through the fluid port 514*a*. The volume is in fluid communication with the inlet 514 and fluid port 514*a* prior to working fluid entry into the coil 504.

Flow control device 520, which in an embodiment is a solenoid valve, is disposed on the line 512 prior to the split into the inlets 514. The flow control device 520 may operate similar to the flow control device 320 described above with respect to FIGS. 3 and 4. The flow control device 520 is controllable, actively to be in either closed or open state, depending on the mode of operation. The flow control device 520 can be controlled by a controller of the cooling system or by a higher system controller, e.g. which controls multiple units, systems, and/or devices.

The cooling systems herein including the implementation of the volume and flow control device for working fluid storage can enjoy many advantages. Such advantages include for example: little or no risk of having vapor in the liquid line (e.g., vapor or non-subcooled liquid in the liquid outlet); little to no risk to trap refrigerant (bottom of the heat exchanger is not closed); no risk to store refrigerant or oil in the volume during operation e.g. cooling mode; liquid sub-cooling level can be insured or maintained; in case of failure of the flow control device; the cooling system may still operate with the same or reduced operating map so there is little to no impact; the flow control device may be controlled automatically (e.g. by an active system) and used for example in a pump down operation, and depending on the mode of operation of the cooling system.

Additional advantages can include for example: good reliability; relatively simple to control; little to no impact on operating performance; relatively easy to integrate in a new or existing cooling system as a retrofit application; without the need to modify the microchannel heat exchanger.

Any of aspects 1 to 8 may be combined with any of aspects 9 to 19, any of aspects 9 to 15 may be combined with any of aspects 16 to 19, and any of aspects 16 to 18 may be combined with aspect 19.

Aspect 1. A heat exchanger comprising:

a microchannel coil, the microchannel coil includes flattened tubes fluidly connected to a header, and fins between the flattened tubes, the flattened tubes include multiple channels fluidly connected with the header to pass a working fluid through the multiple channels of the flattened tubes and through the header, the flattened tubes and fins are constructed and arranged to pass a heat exchange fluid through the microchannel coil externally of the flattened tubes and fins so as to have a heat exchange relationship with the working fluid, the microchannel coil includes a first fluid port fluidly connected with the header, and a second fluid port fluidly connected with the header, in a cooling mode, the first fluid port receives the working fluid, and the second fluid port exits the working fluid after the working fluid has passed through the flattened tubes and the header, in a mode other than the cooling mode, the second fluid port receives the working fluid, and the first fluid port exits the working fluid after the working fluid has passed through the flattened tubes and header; and a volume fluidly connected with the first fluid port, wherein, in the cooling mode, the volume is constructed and arranged to pass the working fluid through the volume and to the first fluid port into the header fluidly connected with the first fluid port, and in the mode other than the cooling mode, the volume is constructed and arranged to receive the working fluid from the first fluid port, and to store the working fluid.

Aspect 2. The heat exchanger of Aspect 1, further comprising a flow control device fluidly connected with the volume, wherein, in the cooling mode, the flow control device is open to pass the working fluid through the volume and into the first fluid port and into the microchannel coil, and in the mode other than the cooling mode, the flow control device is closed, so that the volume stores the working fluid received from the first fluid port.

Aspect 3. The heat exchanger of Aspect 1 or 2, wherein the microchannel coil includes a condensing section, the first fluid port is fluidly connected to an inlet of the condensing section.

Aspect 4. The heat exchanger of any of Aspects 1 to 3, wherein the microchannel coil includes a sub-cooling section, the second fluid port is fluidly connected to an outlet of the sub-cooling section.

Aspect 5. The heat exchanger of any of Aspects 1 to 4, wherein the volume includes a capacity to receive a substantial amount of an operating charge of the working fluid designed for a cooling system in which the heat exchanger is implemented.

Aspect 6. The heat exchanger of any of Aspects 1 to 5, further comprising a fan assembled with the microchannel coil to draw the heat exchange fluid over the microchannel coil.

Aspect 7. The heat exchanger of Aspect 6, wherein the volume is disposed within a perimeter defined by an arrangement of the microchannel coil, the fan, and another coil.

Aspect 8. A cooling system comprising:

a compressor to compress a working fluid;

a first heat exchanger to condense the working fluid, the heat exchanger is fluidly connected with the compressor to receive the working fluid compressed by the compressor;

an expansion device to expand the working fluid, the expansion device is fluidly connected with the first heat exchanger to receive the working fluid condensed by the first heat exchanger; and a second heat exchanger to evaporate the working fluid, the second heat exchanger is fluidly connected with the expansion device to receive the working fluid expanded by the expansion device, the first heat exchanger including:

a microchannel coil, the microchannel coil includes flattened tubes extending between two headers, and fins between the flattened tubes, the flattened tubes include multiple channels fluidly connected with the headers to pass a working fluid through the multiple channels of the flattened tubes and through the headers, the flattened tubes and fins are constructed and arranged to pass a heat exchange fluid through the microchannel coil externally of the flattened tubes and fins so as to have a heat exchange relationship with the working fluid, the microchannel coil includes a first fluid port fluidly connected with one of the headers, and a second fluid port fluidly connected with one of the headers, the first fluid port is arranged relatively at a higher location than the second fluid port, in a cooling mode, the first fluid port receives the working fluid, and the second fluid port exits the working fluid after the working fluid has passed through the flattened tubes and the headers, in a mode other than the cooling mode, the second fluid port receives the working fluid, and the first fluid port exits the working fluid after the working fluid has passed through the flattened tubes and headers; and a volume fluidly connected with the first fluid port, wherein, in the cooling mode, the volume is constructed and arranged to pass the working fluid through the volume and to the first fluid port into the header fluidly connected with the first fluid port, and in the mode other than the cooling mode, the volume is constructed and arranged to receive the working fluid from the first fluid port, and to store the working fluid.

Aspect 9. The cooling system of Aspect 8, wherein the cooling system is a water chiller.

Aspect 10. The cooling system of Aspect 8 or 9, further comprising a flow control device fluidly connected with the volume, wherein, in the cooling mode, the flow control device is open to pass the working fluid through the volume and into the first fluid port and into the microchannel coil, and in the mode other than the cooling mode, the flow control device is closed, so that the volume stores the working fluid received from the first fluid port.

Aspect 11. The cooling system of any of Aspects 8 to 10, wherein the microchannel coil includes a condensing section, the first fluid port is fluidly connected to an inlet of the condensing section.

Aspect 12. The cooling system of any of Aspects 8 to 11, wherein the microchannel coil includes a sub-cooling section, the second fluid port is fluidly connected to an outlet of the sub-cooling section.

Aspect 13. The cooling system of any of Aspects 8 to 12, wherein the volume includes a capacity to receive a substantial amount of an operating charge of the working fluid designed for the cooling system.

Aspect 14. The cooling system of any of Aspects 8 to 13, further comprising a fan assembled with the microchannel coil to draw the heat exchange fluid over the microchannel coil.

Aspect 15. The cooling system of Aspect 14, wherein the volume is disposed within a perimeter defined by an arrangement of the microchannel coil, the fan, and another coil included with the first heat exchanger.

Aspect 16. A method of operating a cooling system comprising:

compressing a working fluid with a compressor;

directing the working fluid to a first heat exchanger according to claim 1 to condense the working fluid;

directing the working fluid from the first heat exchanger to an expansion device to expand the working fluid;

directing the working fluid from the expansion device to a second heat exchanger; and returning the working fluid to the compressor, the step of directing the working fluid from the compressor to the first heat exchanger includes directing the working fluid through a volume prior to the working fluid flowing into a microchannel coil of the first heat exchanger.

Aspect 17. The method of Aspect 16, further comprising storing the working fluid, the step of storing includes directing the working fluid into the first heat exchanger, directing the working fluid from the microchannel coil and out of a fluid port; and directing the working fluid into a volume, and storing the working fluid in the volume.

Aspect 18. The method of Aspect 17, wherein the step of storing the working fluid is during a pump down operation.

Aspect 19. A method of retrofitting an existing cooling system comprising:

fluidly connecting a volume to a fluid line fluidly connecting a compressor to a microchannel heat exchanger;

fluidly connecting the volume to a fluid port, which is fluidly connected to the microchannel heat exchanger; and installing a valve on the fluid line between the compressor and the volume.

The terminology used in this specification is intended to describe particular embodiments and is not intended to be limiting. The terms "a," "an," and "the" include the plural forms as well, unless clearly indicated otherwise.

While the embodiments have been described in terms of various specific embodiments, those skilled in the art will recognize that the embodiments can be practiced with modification within the spirit and scope of the claims.

The invention claimed is:

1. A heat exchanger comprising:

a microchannel coil, the microchannel coil includes flattened tubes fluidly connected to a header, and fins between the flattened tubes, the flattened tubes include multiple channels fluidly connected with the header to pass a working fluid through the multiple channels of the flattened tubes and through the header, the flattened tubes and fins are constructed and arranged to pass a heat exchange fluid through the microchannel coil externally of the flattened tubes and fins so as to have a heat exchange relationship with the working fluid, the microchannel coil includes a first fluid port fluidly connected with the header, and a second fluid port fluidly connected with the header, in a cooling mode, the first fluid port receives the working fluid, and the second fluid port exits the working fluid after the working fluid has passed through the flattened tubes and the header, in a mode other than the cooling mode, the second fluid port receives the working fluid, and the first fluid port exits the working fluid after the working fluid has passed through the flattened tubes and header;

a volume fluidly connected with the first fluid port; and a flow control device fluidly connected with the volume, the volume being disposed between the flow control device and the first fluid port, wherein, in the cooling mode, the flow control device is in an open state and the volume is constructed and arranged to pass the working fluid through the volume and to the first fluid port into the header fluidly connected with the first fluid port, and in the mode other than the cooling mode, the flow control device is in a closed state and the volume is constructed and arranged to receive the working fluid from the first fluid port, and to store the working fluid.

2. The heat exchanger of claim 1, wherein the microchannel coil includes a condensing section, the first fluid port is fluidly connected to an inlet of the condensing section.

3. The heat exchanger of any of claim 1, wherein the microchannel coil includes a sub-cooling section, the second fluid port is fluidly connected to an outlet of the sub-cooling section.

4. The heat exchanger of claim 1, wherein the volume includes a capacity to receive a substantial amount of an operating charge of the working fluid designed for a cooling system in which the heat exchanger is implemented.

5. The heat exchanger of claim 1, further comprising a fan assembled with the microchannel coil to draw the heat exchange fluid over the microchannel coil.

6. The heat exchanger of claim 5, wherein the volume is disposed within a perimeter defined by an arrangement of the microchannel coil, the fan, and another coil.

7. A method of operating a cooling system comprising:

compressing a working fluid with a compressor;

directing the working fluid to a first heat exchanger according to claim 1 to condense the working fluid;

directing the working fluid from the first heat exchanger to an expansion device to expand the working fluid;

directing the working fluid from the expansion device to a second heat exchanger; and returning the working fluid to the compressor, the step of directing the working fluid from the compressor to the first heat exchanger includes directing the working fluid through a volume prior to the working fluid flowing into a microchannel coil of the first heat exchanger.

8. The method of claim 7, further comprising storing the working fluid, the step of storing includes directing the working fluid into the first heat exchanger, directing the working fluid from the microchannel coil and out of a fluid port; and directing the working fluid into a volume, and storing the working fluid in the volume.

9. The method of claim 8, wherein the step of storing the working fluid is during a pump down operation.

10. A cooling system comprising:

a compressor to compress a working fluid;

a first heat exchanger to condense the working fluid, the first heat exchanger is fluidly connected with the compressor to receive the working fluid compressed by the compressor;

an expansion device to expand the working fluid, the expansion device is fluidly connected with the first heat exchanger to receive the working fluid condensed by the first heat exchanger; and a second heat exchanger to evaporate the working fluid, the second heat exchanger is fluidly connected with the expansion device to receive the working fluid expanded by the expansion device, the first heat exchanger including:

a microchannel coil, the microchannel coil includes flattened tubes fluidly connected to a header, and fins between the flattened tubes, the flattened tubes include multiple channels fluidly connected with the header to pass a working fluid through the multiple channels of the flattened tubes and through the header, the flattened tubes and fins are constructed and arranged to pass a heat exchange fluid through the microchannel coil externally of the flattened tubes and fins so as to have a heat exchange relationship with the working fluid, the microchannel coil includes a first fluid port fluidly connected with the header, and a second fluid port fluidly connected with the header, in a cooling mode, the first fluid port receives the working fluid, and the second fluid port exits the working fluid after the working fluid has passed through the flattened tubes and the header, in a mode other than the cooling mode, the second fluid port receives the working fluid, and the first fluid port exits the working fluid after the working fluid has passed through the flattened tubes and header;

a volume fluidly connected with the first fluid port; and a flow control device fluidly connected with the volume, the volume being disposed between the flow control device and the first fluid port, wherein, in the cooling mode, the flow control device is in an open state and the volume is constructed and arranged to pass the working fluid through the volume and to the first fluid port into the header, and in the mode other than the cooling mode, the flow control device is in a closed state and the volume is constructed and arranged to receive the working fluid from the first fluid port, and to store the working fluid.

11. The cooling system of claim 10, wherein the cooling system is a water chiller.

12. The cooling system of claim 10, wherein the microchannel coil includes a condensing section, the first fluid port is fluidly connected to an inlet of the condensing section.

13. The cooling system of claim 10, wherein the microchannel coil includes a sub-cooling section, the second fluid port is fluidly connected to an outlet of the sub-cooling section.

14. The cooling system of claim 10, wherein the volume includes a capacity to receive a substantial amount of an operating charge of the working fluid designed for the cooling system.

15. The cooling system of claim 10, further comprising a fan assembled with the microchannel coil to draw the heat exchange fluid over the microchannel coil.

16. The cooling system of claim 15, wherein the volume is disposed within a perimeter defined by an arrangement of the microchannel coil, the fan, and another coil included with the first heat exchanger.

* * * * *